United States Patent [19]

Halberstadt

[11] 4,259,792

[45] Apr. 7, 1981

[54] ARTICLE OF OUTER FOOTWEAR

[76] Inventor: Johan P. Halberstadt, 25 Arterial Rd. West, Bedfordview, Johannesburg, Transvaal Province, South Africa

[21] Appl. No.: 61,427

[22] Filed: Jul. 27, 1979

[30] Foreign Application Priority Data

Aug. 15, 1978 [ZA] South Africa ..... 78/4637

[51] Int. Cl.[3] ..... A43B 13/18; A43B 13/04; A43B 13/12; A43B 5/06

[52] U.S. Cl. ..... 36/28; 36/30 R; 36/32 R; 36/129

[58] Field of Search ..... 36/25 R, 28, 30 R, 32 R, 36/25, 129

[56] References Cited

U.S. PATENT DOCUMENTS

| | | | |
|---|---|---|---|
| 3,100,354 | 8/1963 | Lombard et al. | 36/32 R |
| 4,043,058 | 8/1977 | Hollister et al. | 36/28 X |
| 4,128,950 | 12/1978 | Bowerman et al. | 36/28 X |

FOREIGN PATENT DOCUMENTS

| | | | |
|---|---|---|---|
| 2706645 | 8/1978 | Fed. Rep. of Germany | 36/32 R |
| 279264 | 3/1952 | Switzerland | 36/28 |

OTHER PUBLICATIONS

Runner's World, vol. 13, No. 10, Oct. 1978, pp. 178 and 179.

*Primary Examiner*—James Kee Chi

*Attorney, Agent, or Firm*—Fitch, Even, Tabin, Flannery & Welsh

[57] ABSTRACT

The invention concerns an article of footwear comprising a footwear upper attached to a footwear base, said footwear base comprising a sole part and a heel part, said heel part having an upper surface on which the weight of a person's foot will press and a lower surface adapted to contact the ground, the area of the lower surface being greater than the area of the upper surface, said lower surface extending outside vertical planes passing through the upper surface at the periphery of the upper surface on both sides of the heel part and behind the heel part, and a peripheral ridge extending upwardly from the surface on which the weight of a person's foot will press, said peripheral ridge flaring outwardly on both sides of the heel part and behind the heel part. The flaring occurs from the top of the ridge to the lower surface of the heel part. The upper inner surface of the heel part is attached to the footwear upper. The article of footwear may be a shoe, especially a running shoe. The new heel part and the new footwear base are also claimed.

3 Claims, 11 Drawing Figures

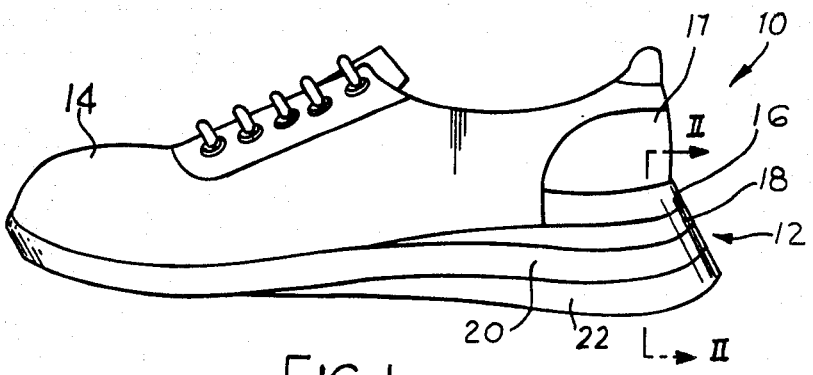
FIG. 1
FIG. 2
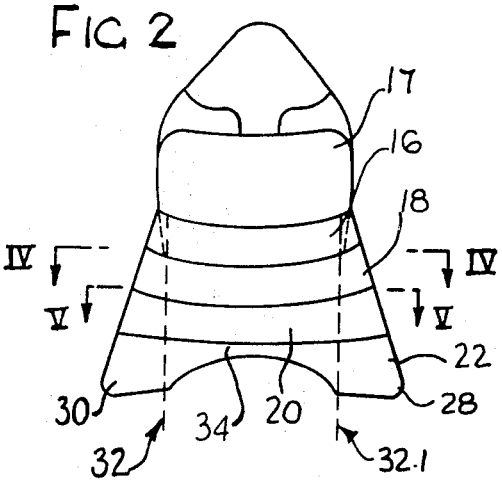
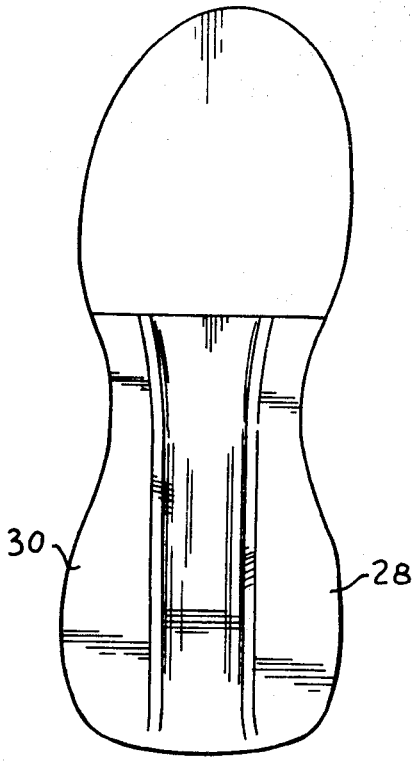
FIG. 3
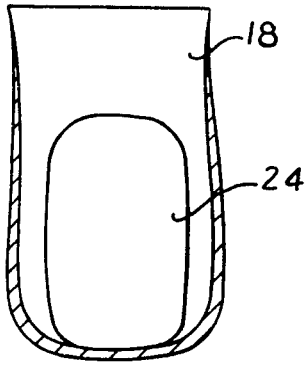
FIG. 4

ARTICLE OF OUTER FOOTWEAR

This invention relates to heels for footwear, to a footwear base and to footwear, particularly to footwear for sports, such as long distance running.

The applicant is aware that with footwear, especially running shoes, there are two fundamental problems with regard to shock absorption by the heel. The first is that with a conventional heel, when people walk or run, most of them usually put their foot down with the outside corner of the heel making contact first with the ground. Thus, very little of the total surface area of the heel actually comes into contact initially with the ground, due to the angle with which the heel strikes the ground. This invariably results in only a very small portion of the total heel area being required to absorb all the shock, so that a significant amount of strain and pressure is borne by the person's ankle, knee and hip joints, as well as associated muscles and tendons in the legs and the spine. A less serious but associated problem is that there is a tendency for the shoe to roll medially under the feet, possible leading to a twisted ankle.

The second fundamental problem is that with a conventional heel, as it wears down, there is less and less cushioning material between the heel of the foot and the ground, thereby increasing the stress on the legs and spine. As the heel of a conventional shoe wears down, more and more of the area of the heel of the foot makes contact with the ground, thereby tending to lessen the stress referred to above.

Although this is a problem with ordinary shoes, boots etc., the problem is accentuated with running shoes for road running. With such shoes, a substantial amount of shock absorption and stability problems arise because of the small area of the heel which makes contact with the ground on impact. As the heel wears down, these problems are lessened. There is also a corresponding increase in stress on the legs and spine due to the lack of cushioning effect. Problems are therefore encountered both with new shoes and shoes that have been worn-in . These problems can be serious with running shoes.

The present invention provides a heel for an article of footwear, the heel comprising an upper surface on which the weight of a person's foot will press and a lower surface adapted to contact the ground, the area of the lower surface being greater than the area of the upper surface, the lower surface extending outside vertical planes passing through the upper surface at the periphery of the upper surface on both sides of the heel and behind the heel, and a peripheral ridge extending upwardly from the surface on which the weight of the person's foot will press, the peripheral ridge flaring outwardly on both sides of the heel and behind the heel from the top of the ridge to the lower surface of the heel.

The invention also provides a footwear base for attachment to a footwear upper to form an article of footwear, the footwear base comprising a sole part and a heel part, the heel part having an upper surface on which the weight of a person's foot will press and a lower surface adapted to contact the ground, the area of the lower surface being greater than the area of the upper surface, the lower surface extending outside vertical planes passing through the upper surface at the periphery of the upper surface on both sides of the heel part and behind the heel part, and a peripheral ridge extending upwardly from the surface on which the weight of the person's foot will press, the peripheral ridge flaring outwardly on both sides of the heel part and behind the heel part from the top of the ridge to the lower surface of the heel, the upper inner surface of the ridge being adapted to be attached to the footwear upper.

The invention further provides an article of footwear comprising the footwear base of the invention attached to a footwear upper.

Conveniently, in cross seciton, the heel may be substantially of a truncated A-shape, with fins extending outwardly on both sides of the heel. The sides of the heel may be a convex surface, a concave surface or substantially a flat surface. There can be a heel counter between the upwardly-extending protruding ridge and the footwear upper and to which the ridge may be attached.

A central longitudinal groove may be provided in the underside of the lower surface of the heel and sole, forming fins on each side of the heel part extending forward into the sole part. The groove may be shallower towards the sole part and deeper towards the back of the heel part. When a grooved heel strikes the ground, the fins (though not necessarily both simultaneously) are the first part of the heel to touch the ground. The fins compress and bend outwardly and upwardly. This action provides a cushioning effect and enables the downward force of the footfall to be spread over a wide area of the heel. A very good latitudinal stability (i.e. a low chance of a twisted ankle) is obtained.

Furthermore, compared with conventional heels known to the Applicant where an ever increasing lack of cushioning occurs as the heel wears down, one or both of the fins have to wear down substantially completely before serious lack of cushioning occurs.

The underside of the heel part of the article of footwear may be a ridge-free continuation of the underside of the sole part, i.e. the heel part may merge into the rear of the sole part.

The heel may be manufactured in one moulded unit or may be made up from a plurality of separate layers. When the heel is made up from a plurality of separate layers they may be of different compressibility. There may be just two layers of different materials, for example a harder wearing bottom part and a softer part above it. Alternatively, there may be a layer of softer material above and below a more rigid layer in order further to spread the impact shock as the heel strikes the ground. The sole part may contain the same number of layers.

In one embodiment the footwear heel can be formed from at least three layers plus a support ridge of cushioning material around the heel counter, above the topmost layer. The support ridge can be made of the same substance as any of the layers. The heel support surface, referred to above, can be formed in the shape of a wedge and preferably is more compressible than the other layers. It may have a piece bevelled out from its upper surface in the shape of a persons heel. If desired, another layer of this soft material may also be provided. The next lowermost layer (which can also form and be integral with, the sole of the footwear) may also have a bevelled out portion in the heel area similar to the topmost layer. The bottommost layer is the layer provided with the fins and may, if desired, only extend longitudinally to slightly forward of the middle of the article of footwear.

When a heel is manufactured in layer form, with the parts bevelled out, the individual layers can be adhesively attached together, e.g. with a suitable glue. Due to the bevelled out portions, the part at the rear of the heel on the longitudinal axis of the piece of footwear will be pulled upwardly towards the topmost layer. The heel part and sole part may have some layers common to each other but, generally, when the base is built up of a plurality of layers, there will be more layers in the heel part than in the sole part.

Alternatively, the complete heel and sole part may be manufactured in one unit if this is desired. For example, plastics (e.g. polyurethane) moulding techiques may be used. Conveniently, there may be two layers of different wearing strengths in each of the heel and the sole parts. The upper layer of at least the heel part may be thicker than the upper layer of the sole part.

Whether or not the heel is manufactured in one unit with the sole or not, the result of providing a heel according to the invention is that when compared with a conventional shoe, better cushioning and stability are obtained. Irrespective of the angle at which the heel strikes the ground, the compression and upward and outward flexing of the fins takes place in such a manner as substantially to prevent or reduce shocks being transmitted to the feet, ankles, legs and spinal column of the wearer, compared with footwear known to the Applicant. In addition, as the heel begins to wear, it conforms more and more to the wearer's particular style without substantially compromising the cushioning effect. Shock absorption and stability can thus be obtained with the foot in a neutral position. Grooves can be provided on the outside of the fins if it is desired that the fins should have more upward flexibility.

The footwear base can be attached to any suitable upper in known manner, eg by adhesive and/or stitching. The article of footwear provided may be a boot, shoe or the like. The invention is especially useful for, but not limited to, sports footwear, e.g. running shoes, cricket boots, baseball shoes, and the like.

The invention is illustrated in non-limiting manner by reference to the accompanying drawing, in which:

FIG. 1 is a side view of one embodiment of a shoe according to the invention;

FIG. 2 is a cross sectional view along II—II of FIG. 1;

FIG. 3 is an underneath plan view of the shoe of FIG. 1;

FIG. 4 is a view along IV—IV of FIG. 2;

Figure 5:
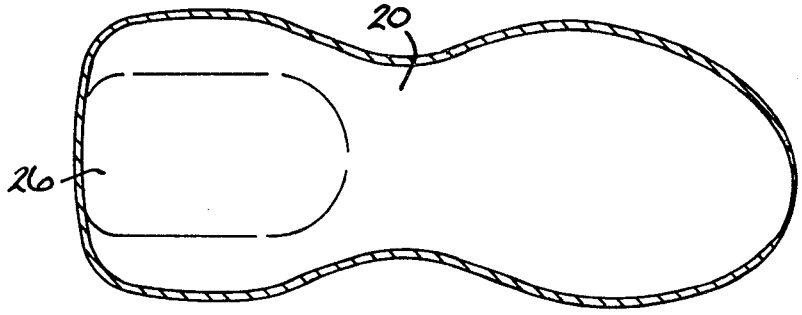
FIG. 5 is a view along V—V of FIG. 2.

In FIGS. 1 to 7 of the drawings, a shoe shown generally at 10 has a shoe base 12 and a shoe upper 14. The base 12 has a heel part integral with a sole part. The heel part includes an upwardly-extending support ridge 16 of cushioning material. The support ridge 16 is adhered to a heel counter 17 which is both glued and stitched to the upper 14.

The heel part comprises three layers, namely an upper soft layer 18, intermediate layer 20 and bottom layer 22. The upper layer 18 forms the heel support surface on which the person's foot will rest. The upper layer 18 has a bevelled cut-out formation 24 provided in its upper surface. Similarly, the layer 20 has a further cut-out formation 26 in its upper surface. The cut-out 26 is wider than the cut-out 24. The shapes of the cut-outs correspond at the front to the shape of the heel of a person's foot.

The bottommost layer 22 has fins 28, 30 projecting outwardly. As can be seen from FIG. 2, the fins 28, 30 project outwardly beyond the vertical broken lines 32, 32.1 which pass downwardly through the outside of the heel at the level of the heel support surface (i.e. the top of the layer 18). The bottommost layer also has a thinner central portion 34 than the outside portion containing the fins 28, 30, thereby defining an inverted groove between the fins 28, 30. Conveniently, the groove is shallower towards its front end.

In use when a person's shoe hits the ground, either fin 28 or fin 30 will contact the ground first of all. (Most individuals have a running style which causes the lateral fin on each shoe to strike the ground first). That fin will be compressed and will be bent upwardly and outwardly until the other fin also makes contact with the ground. Depending on how much downward force is still being exerted by the mass of the individual, the second fin may also be compressed and bent outwardly and upwardly until the central portion 34 touches the ground. Any further force that may still be exerted downwards will mainly be absorbed by the compression of all of the layered cushioning material between the individual's foot and the ground. Because a large part of the total heel area is deployed in the shock absorption, a very good cushioning effect is obtained. Although the fin first making contact with the ground will wear down faster, it becomes thinner as it wears. This causes it to be more flexible and compressible, with the result that more of the downward force is shifted to the other fin and to the central portion 34.

As the heel wears, the angle between the bottom of the heel and the ground decreases thereby spreading the shock absorption over a greater heel area. If the angle at which the foot stikes the ground is such that both fins contact the ground simultaneously, the compression and bending of the fins upwardly and outwardly will also occur simultaneously. The enhanced cushioning effect provided by the invention is not compromised.

Figure 6:
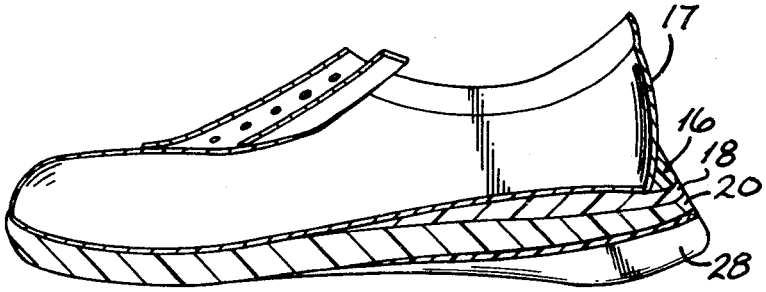
FIG. 6 is a longitudinal cross-section of the shoe of FIG. 1.
Figure 7:
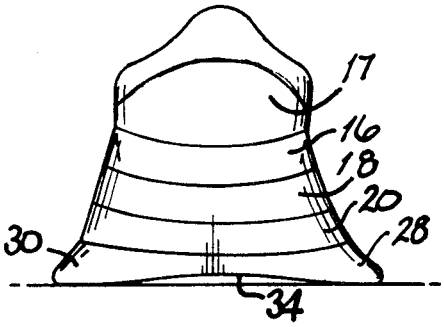
FIG. 7 illustrates how the fins bend on contacting the ground.
Figure 8:
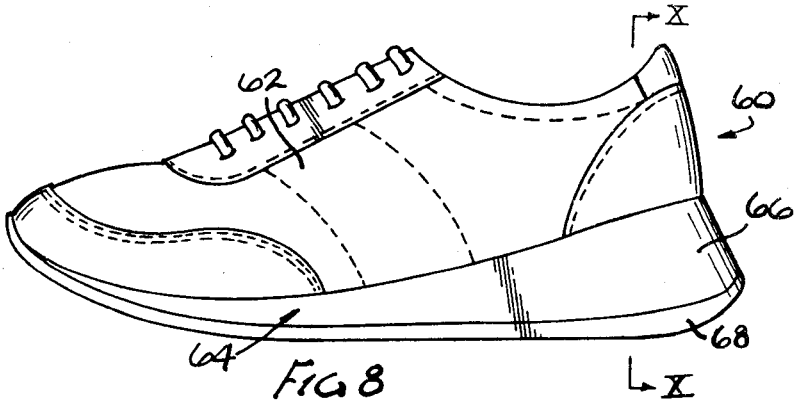
FIG. 8 is a side view of a second embodiment of a shoe according to the invention.
Figure 9:
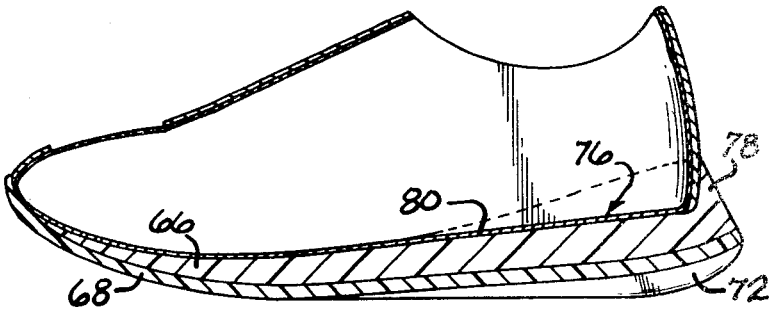
FIG. 9 is a longitudinal cross-section of the shoe of FIG. 8.

As can be seen from FIGS. 1 and 6, the back of the heel also projects outwardly beyond the vertical line drawn through the back of the heel counter.

In FIGS. 8 to 11, a running shoe 60 has upper 62 and moulded base 64. The base comprises a soft polyurethane layer 66 and a harder polyurethane lower layer 68. The shoe upper 62 is glued into the moulded layer 66. The base 64 is formed by bonding the two layers together. The longitudinal groove 70 in the underside of the shoe extends from the back of the shoe, gradually becoming shallower, and ending past the middle of the shoe. Fins 72,74 are defined by the sides of the groove.

The heel support surface, i.e. the surface on which the wearer's foot will press, is indicated at 76. This surface is below the level of the top of the ridge 78. The ridge 78 gives support for the foot at the back and sides thereof. As can be seen, when the shoe is being worn, the base of the wearer's heel will be below the top of the ridge 78.

Figure 10:
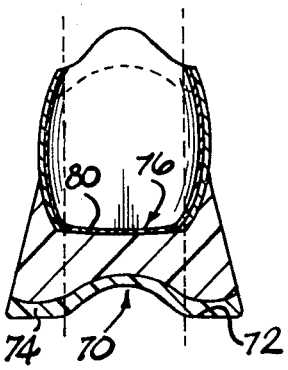
FIG. 10 is a section along X—X of the shoe of FIG. 8.
Figure 11:
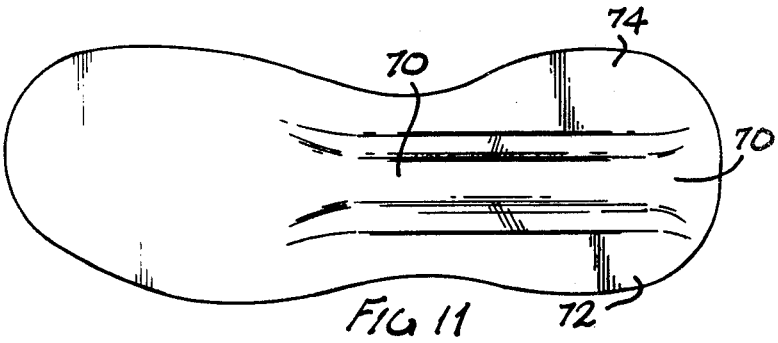
FIG. 11 is an underneath plan view of the shoe FIG. 8.

The shoe upper 62 is adhered into the shoe base 64. Alternatively the base 64 can be moulded around the upper 62. The broken vertical lines in FIG. 10 show the position of vertical planes passing through the outside of the wearer's heel at the level of the heel support surface.

The applicant has found that, not only is the shoe more durable but, more importantly, there is an exceptionally good cushioning effect which is essentially suitable for athletes. In addition, the fins give a slight springing action, thereby assisting an athlete in his next step. Futhermore, in addition to good shock absorption, and distribution of this force over a large area, the heel has to wear down significantly before there is a substantial decrease in the amount of cushioning material between the wearer's heel and the ground. A further advantage is that the shoe wears itself in to suit the wearer's individual gait, while giving good cushioning and support with the foot in a neutral position, i.e. downward forces on both sides of the centre of gravity passing vertically through the foot are equal.

I claim:

1. An article of outer footwear comprising a footwear upper attached to a footwear base, said footwear base including a sole part and a heel part, said heel part having an upper surface on which the weight of a person's foot will press and a lower surface adapted to contact the ground, the area of the lower surface being greater than the area of the upper surface, said lower surface extending outside vertical planes passing through the upper surface at the periphery of the upper surface on both sides of the heel and behind the heel; a peripheral ridge extending upwardly from the upper surface on which the weight of the person's foot will press, said peripheral ridge being positioned to form along its inside surface an upwardly extending support for the sides and back of the person's heel, said peripheral ridge having its outer surface flaring outwardly on both sides of the heel part and behind the heel part from the top of the ridge to the lower surface of the heel part, said ridge also being attached on its inner surface to the footwear upper; and a central longitudinal groove in the underside of the heel part extending forwardly through the heel part into the underside of the sole part to divide the lower surface of the heel part into a pair of fins which are capable of bending outwardly and upwardly when the underside of the heel part strikes the ground.

2. For use in an article of outer footwear, a heel comprising an upper surface on which the weight of a person's foot will press and a lower surface adapted to contact the ground, the area of the lower surface being greater than the area of the upper surface, said lower surface extending outside vertical planes passing through the upper surface at the periphery of the upper surface on both sides of the heel and behind the heel; a peripheral ridge extending upwardly from the upper surface on which the weight of the person's foot will press and positioned adapted to form along its inside surface an upwardly extending support for the sides and back of the heel of the person's foot, said peripheral ridge having its outer surface flaring outwardly on both sides of the heel part and behind the heel part from the top of the ridge to the lower surface of the heel part, said peripheral ridge being adapted to be attached on its inner surface to a footwear upper; and a central longitudinal groove in the underside of the heel part extending completely through the heel part to divide the lower surface of the heel part into a pair of fins capable of being bent outwardly and upwardly when the underside of the heel part strikes the ground.

3. In an article of outer footwear having a footwear upper and a footwear base, the improvement which comprises a footwear base having a sole part and a heel part, said heel part having an upper surface on which the weight of a person's foot will press and a lower surface adapted to contact the ground, the area of the lower surface being greater than the area of the upper surface, said lower surface extending outside vertical planes passing through the upper surface at the periphery of the upper surface on both sides of the heel part and behind the heel part, a peripheral ridge extending upwardly from the upper surface on which the weight of a person's foot will press in a position forming along its inside surface an upwardly extending support for the sides and back of the person's heel, the peripheral heel ridge having its outer surface flaring outwardly on both sides of the heel part and behind the heel part from the top of the ridge to the lower surface of the heel part, said ridge also being attached on its inner surface to the footwear upper, and a central longitudinal groove in the underside of the heel part extending forwardly through the heel part into the rear of the underside of the sole part to divide the lower surface of the heel part into a pair of fins capable of being bent outwardly and upwardly when the underside of the heel part strikes the ground.

* * * * *

US004259792B1

REEXAMINATION CERTIFICATE (3295th)

United States Patent [19] [11] B1 4,259,792

Halberstadt [45] Certificate Issued Aug. 12, 1997

[54] ARTICLE OF OUTER FOOTWEAR

[75] Inventor: Johan P. Halberstadt, Johannesburg, South Africa

[73] Assignee: Hockerson-Halberstadt, Inc., New Orleans, La.

Reexamination Request:
No. 90/003,938, Sep. 5, 1995

Reexamination Certificate for:

| | |
|---|---|
| Patent No.: | **4,259,792** |
| Issued: | **Apr. 7, 1981** |
| Appl. No.: | **61,427** |
| Filed: | **Jul. 27, 1979** |

[30] Foreign Application Priority Data

Aug. 15, 1978 [ZA] South Africa ..... 78/4637

[51] Int. Cl.[6] ..... A43B 13/18; A43B 13/12; A43B 13/04; A43B 5/00

[52] U.S. Cl. ..... 36/28; 36/30 R; 36/32 R; 36/129

[58] Field of Search ..... 36/114, 28, 29, 36/25 R, 30 R, 32 R, 129

[56] References Cited

U.S. PATENT DOCUMENTS

| | | |
|---|---|---|
| 1,622,860 | 3/1927 | Cutler . |
| 1,735,986 | 11/1929 | Wray . |
| 2,071,431 | 2/1937 | Riddell . |
| 2,403,442 | 7/1946 | Klaus . |
| 3,100,354 | 8/1963 | Lombard et al. . |
| 3,290,801 | 12/1966 | Bente . |
| 3,852,895 | 12/1974 | Funck . |
| 3,952,358 | 4/1976 | Fukuoka . |
| 4,128,950 | 12/1978 | Bowerman et al. . |
| 4,161,828 | 7/1979 | Benseler et al. . |
| 4,322,895 | 4/1982 | Hockerson . |
| 4,741,114 | 5/1988 | Stubblefield . |

*Primary Examiner*—BethAnne C. Dayoan
*Attorney, Agent, or Firm*—Flehr Hohbach Test Albritton & Herbert LLP

[57] ABSTRACT

The invention concerns an article of footwear comprising a footwear upper attached to a footwear base, said footwear base comprising a sole part and a heel part, said heel part having an upper surface on which the weight of a person's foot will press and a lower surface adapted to contact the ground, the area of the lower surface being greater than the area of the upper surface, said lower surface extending outside vertical planes passing through the upper surface at the periphery of the upper surface on both sides of the heel part and behind the heel part, and a peripheral ridge extending upwardly from the surface on which the weight of a person's foot will press, said peripheral ridge flaring outwardly on both sides of the heel part and behind the heel part. The flaring occurs from the top of the ridge to the lower surface of the heel part. The upper inner surface of the heel part is attached to the footwear upper. The article of footwear may be a shoe, especially a running shoe. The new heel part and the new foot-wear base are also claimed.

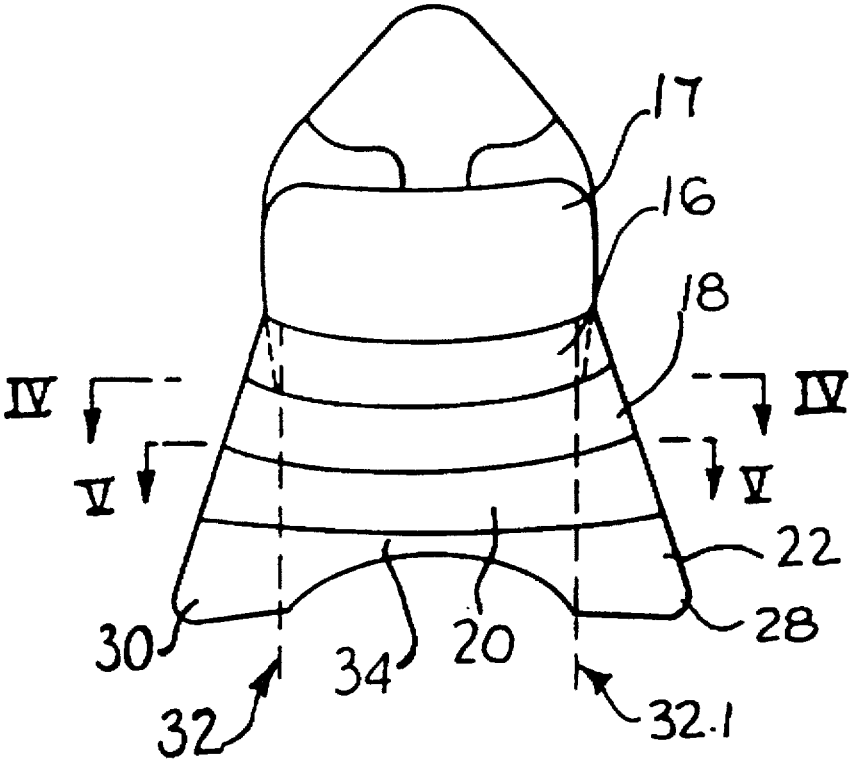

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 46–47:

FIG. 2 is a [cross sectional view along II—II] *rear elevation view of the shoe* of FIG. 1;

AS A RESULT OF REEXAMINATION, IT HAS BEEN DETERMINED THAT:

The patentability of claim 2 is confirmed.

Claims 1 and 3 are determined to be patentable as amended.

1. An article of outer footwear comprising a footwear upper attached to a footwear base, said footwear base including a sole part and a heel part, said heel part having an upper surface on which the weight of a person's foot will press and a lower surface adapted to contact the ground, the area of the lower surface being greater than the area of the upper surface, said lower surface extending outside vertical planes passing through the upper surface at the periphery of the upper surface on both sides of the heel and behind the heel; a peripheral ridge extending upwardly from the upper surface on which the weight of the person's foot will press, said peripheral ridge being positioned to form along its inside surface an upwardly extending support for the sides and back of the person's heel, said peripheral ridge having its outer surface flaring outwardly on both sides of the heel part and behind the heel part from the top of the ridge to the lower surface of the heel part, said ridge also being attached on its inner surface to the footwear upper; and a central longitudinal groove in the underside of the heel part extending [forwardly] *completely* through the heel part into the underside of the sole part to divide the lower surface of the heel part into a pair of fins which are capable of bending outwardly and upwardly when the underside of the heel part strikes the ground.

3. In an article of outer footwear having a footwear upper and a footwear base, the improvement which comprises a footwear base having a sole part and a heel part, said heel part having an upper surface on which the weight of a person's foot will press and a lower surface adapted to contact the ground, the area of the lower surface being greater than the area of the upper surface, said lower surface extending outside vertical planes passing through the upper surface at the periphery of the upper surface on both sides of the heel part and behind the heel part, a peripheral *heel* ridge extending upwardly from the upper surface on which the weight of a person's foot will press in a position forming along its inside surface an upwardly extending support for the sides and back of the person's heel, the peripheral heel ridge having its outer surface flaring outwardly on both sides of the heel part and behind the heel part from the top of the ridge to the lower surface of the heel part, said ridge also being attached on its inner surface to the footwear upper, and a central longitudinal groove in the underside of the heel part extending [forwardly] *completely* through the heel part into the rear of the underside of the sole part to divide the lower surface of the heel part into a pair of fins capable of being bent outwardly and upwardly when the underside of the heel part strikes the ground.

* * * * *